US006336617B1

(12) United States Patent
Barber et al.

(10) Patent No.: US 6,336,617 B1
(45) Date of Patent: Jan. 8, 2002

(54) RATCHET TILT MECHANISM

(76) Inventors: Peter Barber, 234 Garafraxa St. E., Fergus, Ontario (CA), N1M 1E1; James LeClair, 28-281 Bluevall St. N., Waterloo, Ontario (CA), N2J 4L8

( * ) Notice: Subject to any disclaimer, the term of this patent is extended or adjusted under 35 U.S.C. 154(b) by 0 days.

(21) Appl. No.: 09/399,486

(22) Filed: Sep. 20, 1999

Related U.S. Application Data

(60) Provisional application No. 60/107,371, filed on Nov. 6, 1998.

(51) Int. Cl.[7] ..... E04G 3/00; A47F 5/12

(52) U.S. Cl. ..... 248/276.1; 248/918; 108/6

(58) Field of Search ..... 248/276.1, 281.1, 248/274, 278, 918, 919, 920, 921, 922, 923, 924, 652, 664, 371, 292.12; 108/6, 7, 9

(56) References Cited

U.S. PATENT DOCUMENTS

| | | | | |
|---|---|---|---|---|
| 4,154,173 A | * | 5/1979 | Chesnut | 108/6 |
| 4,196,674 A | * | 4/1980 | Van Laarhoven | 108/9 |
| 4,560,137 A | * | 12/1985 | Svoboda | 248/652 |
| 4,585,212 A | | 4/1986 | Yanker | 254/122 |
| 4,589,621 A | | 5/1986 | Hunt et al. | 248/586 |
| 4,616,798 A | | 10/1986 | Smeenge et al. | 248/281.1 |
| 4,632,349 A | | 12/1986 | Anstey | 248/281.1 |
| 4,790,611 A | | 12/1988 | Craner | 312/306 |
| 4,826,123 A | | 5/1989 | Hannah et al. | 248/248 |
| 4,843,978 A | | 7/1989 | Schmidt et al. | 108/138 |
| 4,988,066 A | | 1/1991 | Cotterill | 248/281.1 |
| 5,037,054 A | | 8/1991 | McConnell | 248/284 |
| 5,145,136 A | | 9/1992 | McConnell | 248/284 |
| 5,257,767 A | | 11/1993 | McConnell | 248/284 |
| 5,823,487 A | * | 10/1998 | Kirchhoff et al. | 248/918 |

FOREIGN PATENT DOCUMENTS

| | | |
|---|---|---|
| CH | 99489 | 6/1923 |
| CH | NR162103 | 8/1933 |

(List continued on next page.)

OTHER PUBLICATIONS

Industrial Design in Engineering, by Charles H. Flurscheim, 1983.

Industrial Design Magazine's 28th annual review, Published by Design Publications, 1982.

Design of a Three–Degree–of–Freedom Robotic Worktable With Prescribed Entire–Motion Characteristics, by Jau–Jung Chen, Sep. 1986.

*Primary Examiner*—Ramon O. Ramirez
*Assistant Examiner*—J. DeLuca
(74) *Attorney, Agent, or Firm*—Banner & Witcoff, Ltd.

(57) ABSTRACT

There is disclosed a tilt control mechanism for a keyboard support platform. The keyboard support platform is of the type that includes linkage for connecting the platform to a work surface. The linkage further includes linkage arms that pivotally connect the keyboard support platform to the work surface. The tilt control mechanism comprises a tilt adjustment actuator arm and a pawl and ratchet connection between the actuator arm and the support platform. The pawl and ratchet provide a series of separate detent positions which define distinct length actuator arm connections between a fulcrum point and the support platform to thereby control the tilt of the platform.

18 Claims, 4 Drawing Sheets

FOREIGN PATENT DOCUMENTS

| | | |
|---|---|---|
| CH | NR255365 | 1/1949 |
| CH | 664549 | 10/1984 |
| DE | 2535042 | 8/1975 |
| DE | 3323780 | 7/1983 |
| EP | 0017222 | 4/1980 |
| EP | 0256610 | 3/1987 |
| EP | 0341358 | 5/1988 |
| EP | 0405234 | 6/1990 |
| EP | 0322994 | 8/1992 |
| EP | 0415176 | 5/1995 |
| FR | 2517942 | 12/1982 |
| FR | 2547195 | 6/1983 |
| JP | 4732098 | 9/1972 |
| JP | 48101256 | 12/1973 |
| JP | 491361 | 1/1974 |
| JP | 4910887 | 3/1974 |
| JP | 49337640 | 3/1974 |
| JP | 4938753 | 4/1974 |
| JP | 5017535 | 5/1975 |
| JP | 5190657 | 8/1976 |
| JP | 51148567 | 12/1976 |
| JP | 51151446 | 12/1976 |
| JP | 5230560 | 3/1977 |
| JP | 5393961 | 8/1978 |
| JP | 54127761 | 10/1979 |
| JP | 55119292 | 9/1980 |
| JP | 5769199 | 4/1982 |
| JP | 6044689 | 3/1985 |
| JP | 60146997 | 8/1985 |
| JP | 61136095 | 6/1986 |
| JP | 1250694 | 10/1989 |
| SE | 7308797 | 8/1916 |
| WO | WO8810081 | 12/1988 |

* cited by examiner

RATCHET TILT MECHANISM

This application claims the benefit of U.S. Provisional Application No. 60/107,371, filed Nov. 6, 1998.

BACKGROUND OF THE INVENTION

This invention relates in general to a support platform for a computer keyboard or the like and, more particularly, to a tilt control or pitch control mechanism for a keyboard support platform. The tilt control mechanism of the present invention permits the selective adjustment of the pitch or tilt of the support platform to allow the user to set the work angle of the keyboard.

The keyboard support platform construction is of the type generally shown in McConnell, U.S. Pat. No. 5,037,054 and U.S. Pat. No. 5,145,136, or Smeenge et al., U.S. Pat. No. 4,616,798. The aforesaid McConnell and Smeenge patents are incorporated herein by reference. Typically, a keyboard support platform is attached by parallel and/or non-parallel pivotal linkage arms to a slidable plate. The slidable plate, in turn, is mounted in a slide on the underside of a desk or other work surface. The slide permits the keyboard support platform and linkage to move between a storage position or retracted position to an extended or use position. The conventional pivotal linkage arms further permit the keyboard support platform to be adjusted to a useful operational work height.

The conventional keyboard support platform assemblies, however, are limited in the degree of keyboard tilt. That is, known keyboard platform assemblies limit the operational work angle of the keyboard and, therefore, do not ergonomically comply with the requirements of all users. Because conventional keyboard support platform assemblies are so limited, keyboard users have suffered from various debilitating medical conditions. As an example, it has been shown that without the proper work angle setting of the keyboard, users who perform considerable data entry on the keyboard have suffered from Carpal Tunnel Syndrome which is a medical disorder of the hand that creates numbness and pain in the fingers. Consequently, there is a need for an improved keyboard support platform assembly which provides not only adjustable work height of the keyboard but also improved adjustment of the tilt or work angle of the keyboard to prevent such debilitating medical conditions.

SUMMARY OF THE INVENTION

The present invention recognizes and provides a solution to the aforementioned problems associated with the known keyboard support platform assemblies. Accordingly, it is an object of the present invention to provide an improved adjustable support mechanism for a keyboard support platform. It is a further object to provide an adjustable tilt control mechanism which permits the user to set the pitch or angle of the keyboard support platform.

Briefly, in summary, the present invention comprises a tilt control mechanism for a keyboard support platform. The keyboard support platform is of the type that includes a linkage for connecting the platform to a work surface. The linkage further includes linkage arms which pivotally connect the keyboard support platform to the work surface. The tilt control mechanism comprises a keyboard support platform bracket having a tilt pivot axis connection to the linkage arms, and a tilt adjustment actuator arm pivotally attached at a fulcrum point at one end to the pivot axis connection. Connected between the actuator arm and support platform is a pawl and ratchet. The pawl and ratchet connection define distinct length actuator arm connections between the fulcrum point and the support platform to thereby control the tilt or pitch of the platform.

The full range of objects, aspects and advantages of the invention are only appreciated by a full reading of this specification and a full understanding of the invention. Therefore, to complete this specification, a detailed description of the invention and the preferred embodiment follows, after a brief description of the drawing.

BRIEF DESCRIPTION OF THE DRAWING

The preferred embodiment of the invention will be described in relation to the accompanying drawing. In the drawing, the following figures have the following general nature.

In the accompanying drawing, like reference numerals are used throughout the various figures for identical structures.

DESCRIPTION OF THE PREFERRED EMBODIMENT

Figure 1:
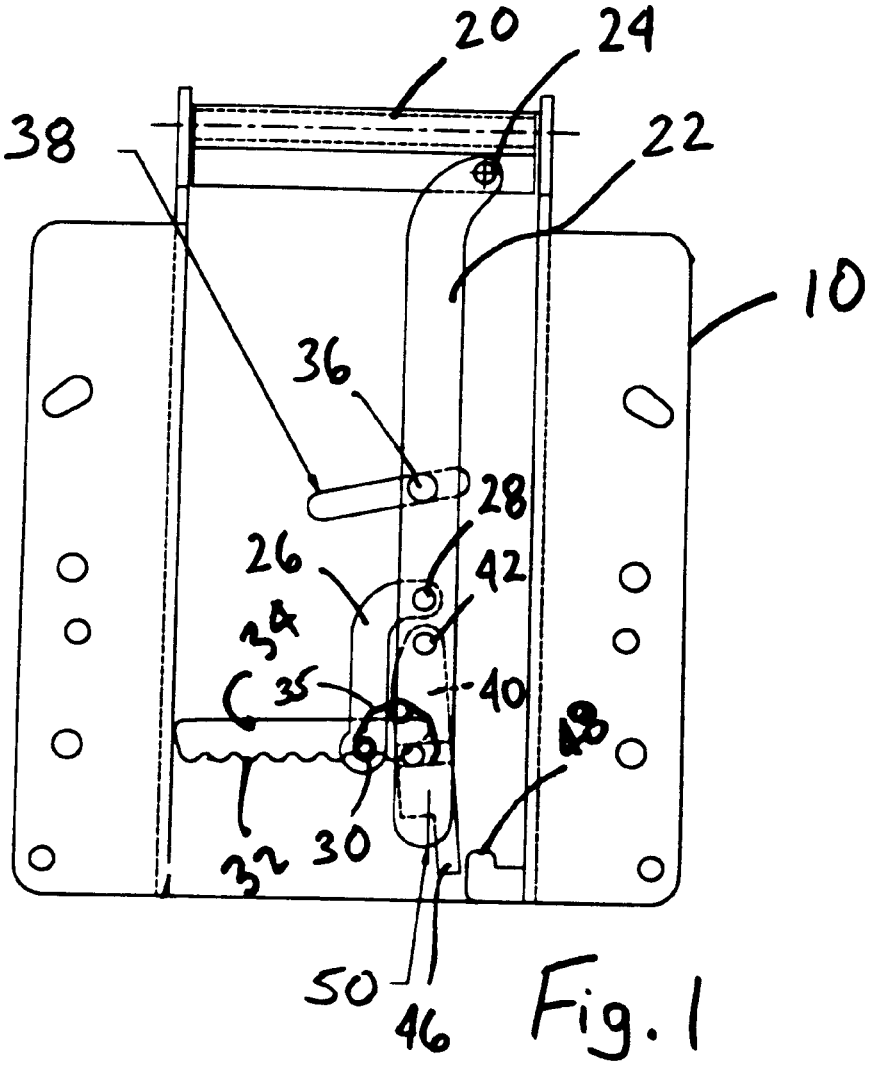
FIG. 1 is a plan view of the tilt control mechanism of the invention as incorporated with a keyboard support platform.
Figure 2:
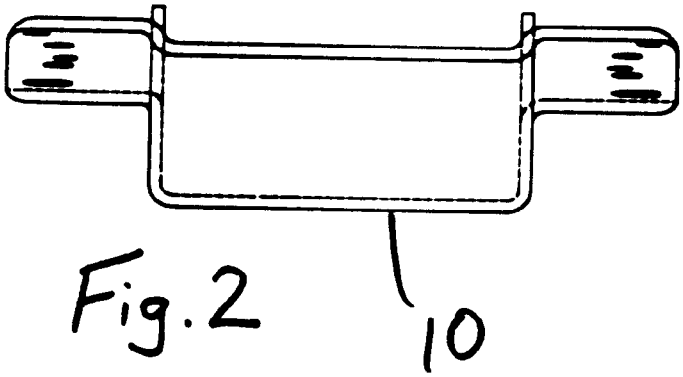
FIG. 2 is an end elevation view of a keyboard support platform.
Figure 3:
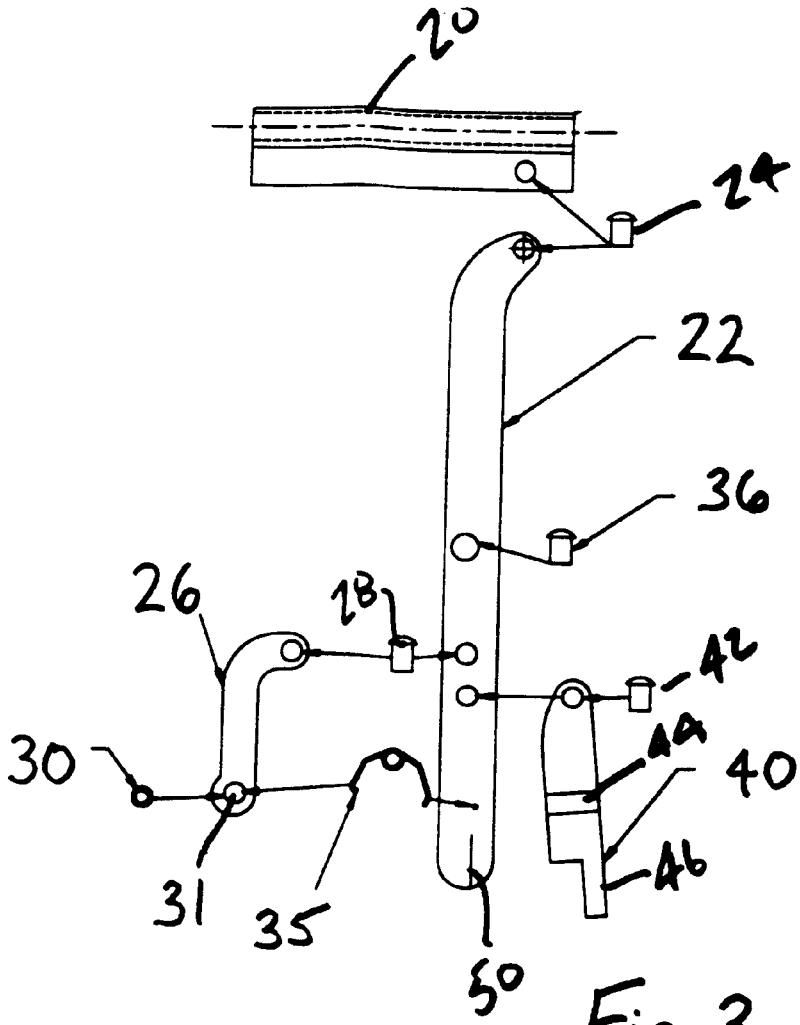
FIG. 3 is an exploded plan view of the component parts of the tilt adjustment mechanism of the invention of FIG. 1.
Figure 4:
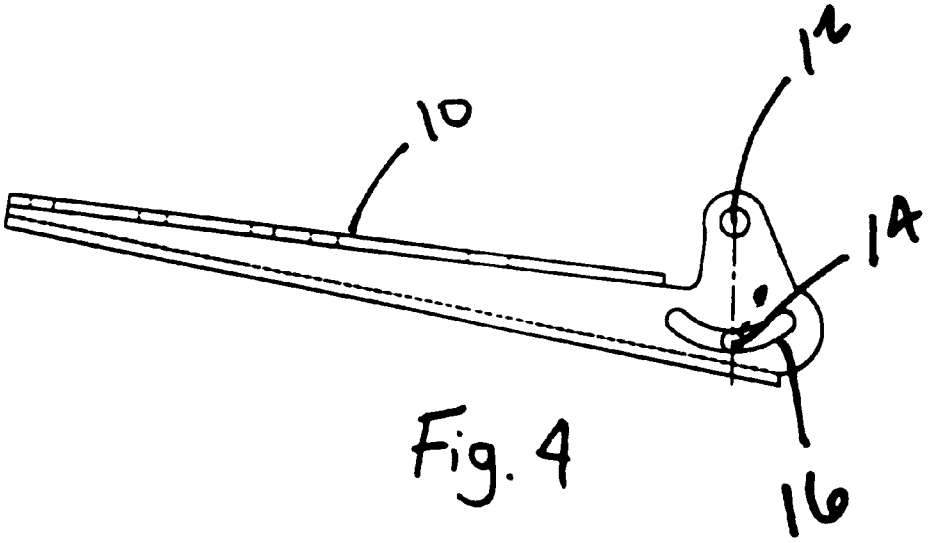
FIG. 4 is a side elevation view of the platform of FIG. 2.
Figure 5:
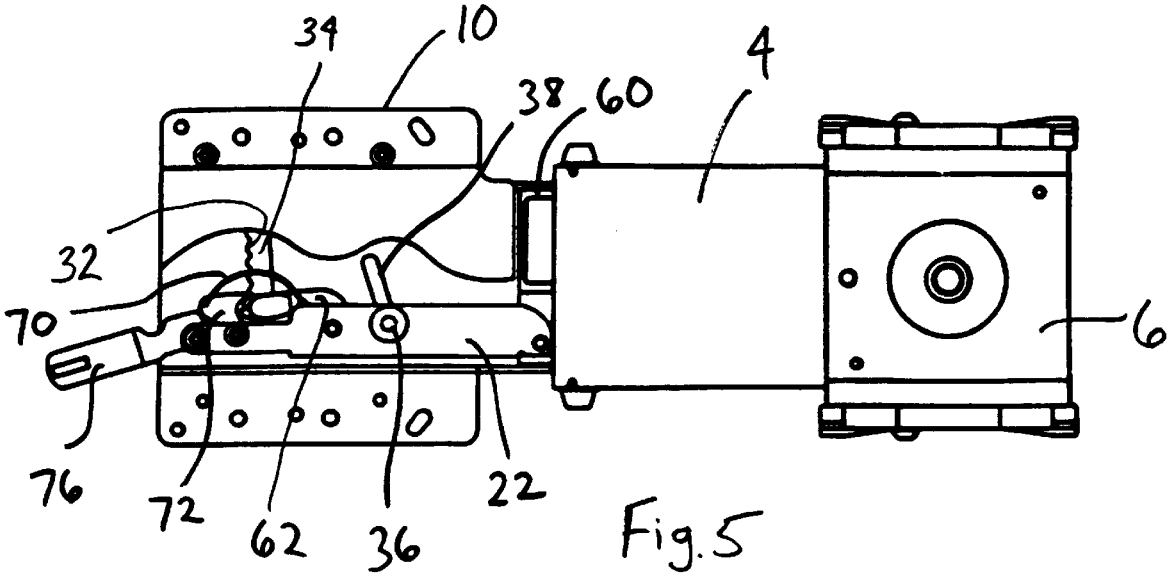
FIG. 5 is a plan view of a keyboard support platform with a partial cut-away view of an alternative embodiment of the tilt control mechanism of the invention.
Figure 6:
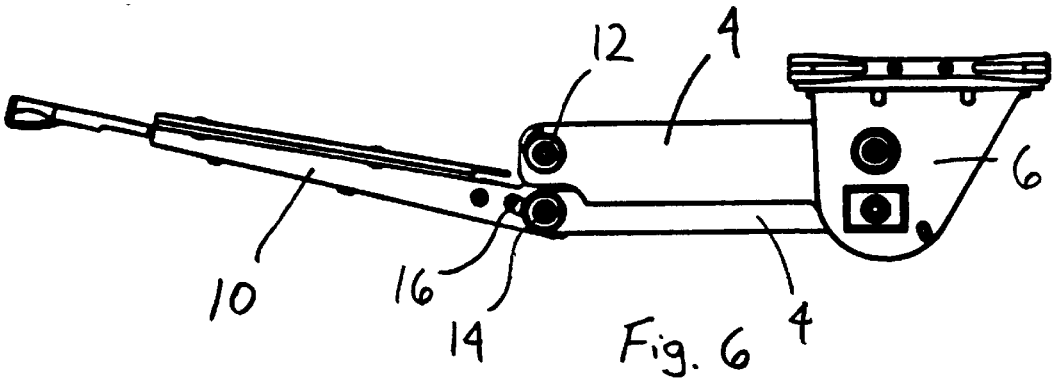
FIG. 6 is a side elevation view of a keyboard support platform of FIG. 5.
Figure 7:
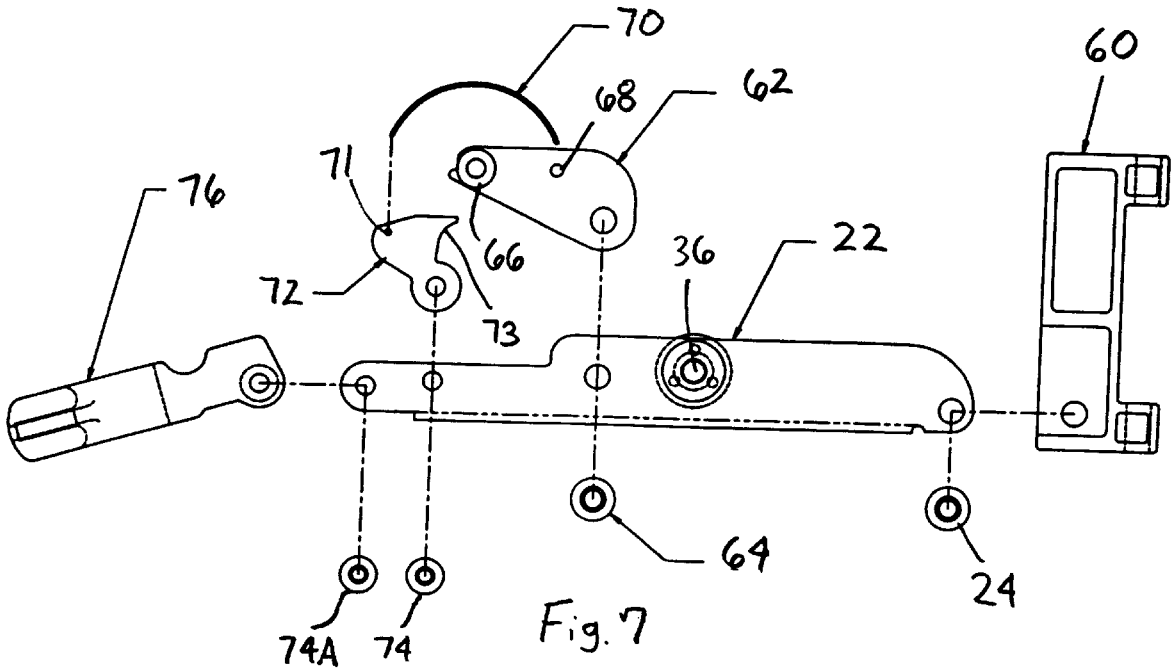
FIG. 7 is an exploded plan view of the component parts of the tilt adjustment mechanism of the invention of FIG. 5.
Figure 8:
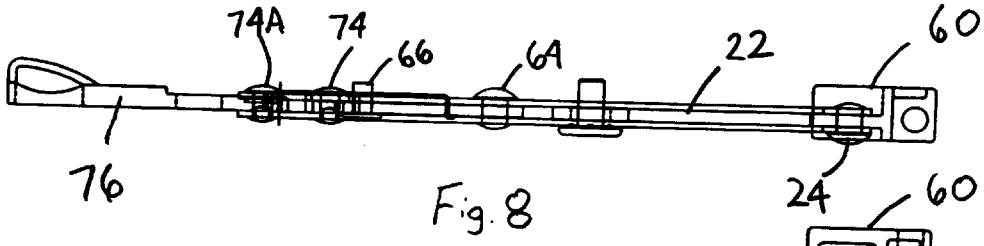
FIG. 8 is a side elevation view of the tilt adjustment mechanism of FIG. 7.

Referring to the figures, the keyboard support platform, such as platform 10, is typically attached to linkage arms 4 by means of a first pivot shaft 12 and a second pivot shaft 14. The linkage arms are conventionally connected to a slide bracket assembly 6 which, in turn, is attached to the work surface. Typically, the bracket assembly 6 supports the weight of the keyboard platform and permits sliding movement of the keyboard platform from a retracted position to an extended position. The platform 10 may be pivoted about the shaft 12 in order to adjust the tilt or pitch of the platform. The shaft 14 fits through an arcuate slot 16 to accommodate the change in pitch of the platform 10.

The subject matter of the present invention relates to a mechanism which permits adjustment of tilt about the shaft 12 by movement of the platform along the range defined by the arcuate slot 16. Referring to FIGS. 1–4, in a preferred embodiment, the mechanism includes an actuator arm block 20 which is fitted over the shaft 14 and thus remains fixed in position relative to the axis defined by the shaft 14. The actuator arm 22 connects the actuator arm block 20 to the platform 10. As more fully discussed below, by adjusting the length of the connection defined by the actuator arm 22 between block 20 and the platform 10, one is able to adjust the tilt of the platform 10 to any of a number of incremental positions. Thus, the actuator arm 22 and the mechanism for connecting and adjusting the length of the connection of that arm 22 to the platform 10, herein described as a pawl and ratchet mechanism, relates specifically to the subject matter of the invention.

The actuator arm 22 is connected to the actuator arm block 20 by means of a pivot or pin 24. Pivotally connected to the actuator arm 22 by a pin 28 is a pawl which is further defined as a roll pin arm 26 and a roll pin 30. The roll pin arm 26 receives the roll pin 30 which fits within opening 31 defined in the roll pin arm 26. As illustrated in FIG. 1, the roll pin 30 operatively engages with a ratchet which is defined as a number of spaced detents 32 further defined in a detent slot 34 in the platform 10. A spring 35 connected between the roll pin arm 26 and the end of the actuator arm 22 biases the roll pin arm 26 toward the actuator arm 22. The spring 35 also causes the roll pin 30 to be engaged with a detent 32 and remain engaged therewith.

Depending upon the detent 32, which is engaged by the pin 30, one is able to control the pitch or tilt of the platform 10 inasmuch as one thereby adjusts the length of the actuator arm 22 between pin 24 and the detent 32 engagement with the platform 10. This length adjustment of the actuator arm 22 causes the tilt or pitch of the platform 10 to vary. As preferred, the detents 32 are spaced to provide 5° increments in tilt of the platform 10.

As a secondary or failsafe alignment feature of the invention, the actuator arm 22 includes a pin or rivet 36 which projects from the actuator arm 22 into an inclined slot 38 in the platform 10. The configuration of the slot 38 as well as the detent slot 34 provides accommodation for variance of the pitch or tilt of the platform as the arm 22 is pivoted clockwise or counterclockwise about the pin or rivet 24.

A release arm 40 is pivotally attached to the actuator arm 22 by means of a pin 42. The release arm 40 includes an inclined cam surface 44 and a release projection 46 which cooperates with a release tab 48 in the platform 10, described in greater detail below. The distal end of the actuator arm 22, the end opposite the pivot 24, includes a crimp or projecting lip 50 which cooperates with the release arm 40.

In operation, as depicted in FIG. 1, the platform 10 is raised to its highest or most clockwise tilt in the range of tilt by pulling upwardly on the platform 10. By pulling upwardly on the platform, the release arm 40 is caused to pivot clockwise about the pin 42 whereby the inclined surface or cam 44 will engage against the roll pin arm 26 causing the arm 26 to pivot clockwise about the pin 28 against the biasing force of spring 35. The roll pin arm 26 pivoting about the pin 28 in a clockwise sense releases the roll pin 30 from detent 32. By pulling on the platform to move it in a clockwise direction, the release arm 40 is caused to engage the release tab 48, and more particularly, the projection 46 engages the tab 48 as the arm 22 is pivoted toward the last detent position. This causes the arm 40 to be engaged with the crimp 50 thereby holding the assembly in a fixed locked open position with the roll pin 30 released from the slot 34. When in this position, the entire platform 10 may be lowered to its low end of the tilt range. When so lowered to this low end, the release arm 40 is released or disengaged by the crimp 50. The pin 30 may then be biased into one of the detent slots or openings 32.

To summarize, the, condition of the platform 10, as depicted in FIG. 1, is that of being almost at the top of the range of tilt and thus the length of the actuator arm 22 between pin 24 and detent 32 is at its shortest length. In contrast, at the longest length of the distance between the pin 24 and the roll pin 30, the platform 10 is at its lowest end of the tilt range with intermediate steps represented by detents 32 therebetween. In practice, the platform 10 is raised to its uppermost tilt range by releasing the engagement of the roll pin 30 and the detents 32 as previously described. It is then moved to its lowest tilt range where upon the release arm 40 is disengaged causing the detent roll pin 30 to engage with the first detent 32. Thereafter, by manually raising the platform 10, the platform tilt may be adjusted from one detent to the next as the pin 30 moves from left to right in FIG. 1.

Referring to FIGS. 5–9, an alternative preferred embodiment of the invention in depicted. In this embodiment, an actuator arm block 60 is fitted over the shaft 14. As above, the actuator arm block 60 is connected to the actuator arm 22 through the means of the pin 24. The pin 24 permits rotation of the actuator arm 22 relative to the actuator arm block 60. Pivotally connected to the actuator arm 22 by a rivet 64 is the pawl. In a preferred embodiment, the pawl defines an actuator hook 62. The actuator hook 62 receives a rivet 66 which, as above, operatively engages with the ratchet. That is, the rivet 66 fits into any one of the number of spaced detents 32 defined in the detent slot 34 in the platform 10. The actuator hook 62 further defines an opening 68 for receiving a lock spring 70. The lock spring 70 connects the actuator hook 62 to an opening 71 in an actuator hook lock 72. The actuator hook lock 72 is pivotally connected to the actuator arm by a rivet 74. The actuator hook lock 72 defines a cam surface 73 that contacts and engages the actuator hook 62. Pivotally connected to the end of the actuator arm 22 through the use of a rivet 74A is a lock-out handle 76.

Figure 9:
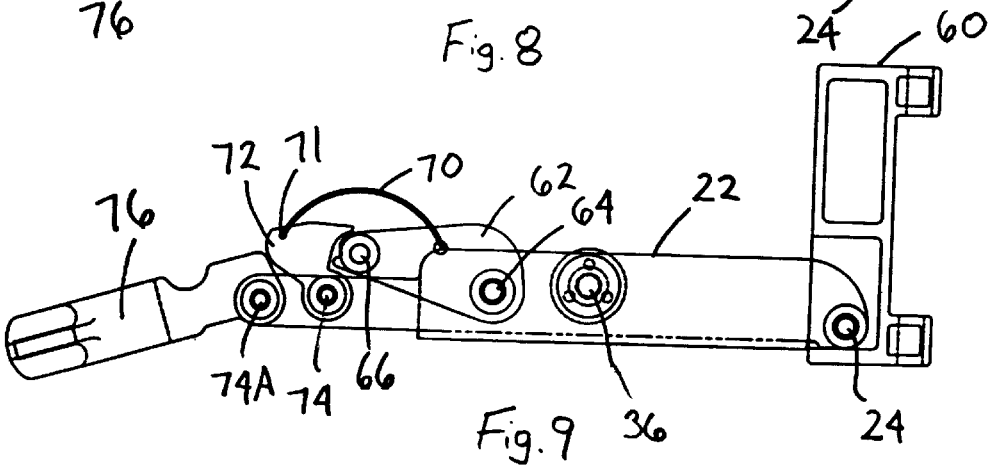
FIG. 9 is a plan view of the tilt adjustment mechanism of FIG. 7.

In operation to change the pitch of the keyboard platform, the lock-out handle 76 is manually rotated about rivet 74A until the handle 76 contacts the actuator hook lock 72, as depicted in FIG. 9. The actuator hook lock 72, in turn, pivots about rivet 74 causing the cam surface 73 of the hook lock 72 to contact the actuator hook 62 forcing the actuator hook 62 to rotate about the rivet 64 and thus lifting the rivet 66 away from the detent 32. Once lifted away from the detent 32, the rivet 66 may be incrementally positioned within an adjacent detent 32, thereby effectively changing the tilt or pitch of the platform. The lock spring 70 holds the actuator hook 62 in operative engagement with the cam surface of the hook lock 72.

Again, a failsafe alignment feature is incorporated which includes the pin 36 that projects from the actuator arm 22 into the inclined slot 38 in the platform 10. As above, the configuration of the slot 38 accommodates the variance of the pitch or tilt of the platform as the arm 22 is pivoted clockwise or counterclockwise about the pin 24.

The preferred embodiments of the invention are now described as to enable a person of ordinary skill in the art to make and use the same. Variations of the preferred embodiment are possible without being outside the scope of the present invention. Therefore, to particularly point out and distinctly claim the subject matter regarded as the invention, the following claims conclude the specification.

What is claimed is:

1. In a keyboard support assembly of the type including a keyboard support platform and linkage arms connecting the platform to a support surface, the keyboard support platform movable by the linkage arms to a work position, the improvement of a tilt control mechanism for the keyboard support platform, the tilt control mechanism comprising:

a keyboard support platform tilt pivot axis;

a tilt adjustment actuator arm operatively connected to the keyboard support platform;

a pawl and ratchet connection between the actuator arm and the keyboard support platform, the pawl and ratchet including a slot in the platform providing a series of separate detent positions for connection to the actuator arm to control the tilt of the platform; and a lock and release mechanism for the pawl and ratchet.

2. The keyboard support assembly of claim 1 wherein the pawl and ratchet connection include a roll pin arm attached to the actuator arm defining the pawl.

3. The keyboard support assembly of claim 2 wherein the roll pin arm further includes a roll pin.

4. The keyboard support assembly of claim 1 wherein the lock and release mechanism includes a roll pin and a release arm for engaging and releasing the roll pin.

5. The keyboard support assembly of claim 4 wherein the release arm includes an inclined cam surface.

6. The keyboard support assembly of claim 1 wherein the actuator arm includes a pin which projects from the actuator arm, and wherein the keyboard support platform includes a second slot with the pin operatively engaging the second slot in the keyboard support platform.

7. The keyboard support assembly of claim 1 wherein the actuator arm further includes a projecting lip.

8. A keyboard support platform assembly comprising, in combination:

a keyboard support platform defining a pivot axis, a pivot block mounted to the keyboard support platform at the pivot axis, and a tilt control mechanism operatively mounted to the keyboard support platform and the pivot block, the tilt control mechanism further comprising a tilt adjustment actuator arm pivotally attached to the pivot block, and a pawl and ratchet connection between the actuator arm and the keyboard support platform, whereby the actuator arm and the pawl and ratchet connection are adjustable to control the tilt of the keyboard support platform.

9. The keyboard support platform assembly of claim 8 wherein the pawl ratchet connection comprise a series of separate detent positions.

10. The keyboard support platform assembly of claim 8 further comprising a lock and release mechanism for the pawl and ratchet.

11. The keyboard support platform assembly of claim 10 wherein the pawl and ratchet include a slot in the platform with detents defining the ratchet and an actuator hook attached to the actuator arm defining the pawl.

12. The keyboard support platform assembly of claim 11 wherein the actuator hook further includes a pin.

13. The keyboard support platform assembly of claim 11 wherein the lock and release mechanism includes an actuator hook lock that operatively engages the actuator hook.

14. The keyboard support assembly of claim 13 wherein the actuator hook lock includes a cam surface.

15. The keyboard support assembly of claim 8 wherein the actuator arm includes an actuator arm pin which projects from the actuator arm, and the keyboard support platform includes a slot whereby the actuator arm pin operatively engages the slot in the keyboard support platform.

16. A keyboard support platform assembly comprising, in combination:

a keyboard support platform, and a tilt control mechanism operatively engaged to the keyboard support platform, the tilt control mechanism further comprising a tilt adjustment actuator arm connected to the keyboard support platform, and a pawl and ratchet connection between the actuator arm and a slot in the keyboard support platform, whereby the actuator arm and the pawl and ratchet connection control the tilt of the platform, said pawl and ratchet comprising a hook and pin a defining the pawl.

17. The keyboard support platform assembly of claim 16 further comprising a lock and release mechanism for the pawl and ratchet.

18. The keyboard support platform assembly of claim 16 wherein the slot in the platform includes detents defining the ratchet.

* * * * *